United States Patent [19]

Shimamura et al.

[11] 3,997,348

[45] Dec. 14, 1976

[54] COLOR PHOTOGRAPHIC PROCESSING METHOD

[75] Inventors: Isao Shimamura; Haruhiko Iwano, both of Minami-ashigara, Japan

[73] Assignee: Fuji Photo Film Co., Ltd., Minami-ashigara, Japan

[22] Filed: July 15, 1974

[21] Appl. No.: 488,853

[30] Foreign Application Priority Data

July 13, 1973 Japan ..... 48-78983

[52] U.S. Cl. ..... 96/56; 96/22; 96/60 R; 96/60 BF

[51] Int. Cl.[2] ..... G03C 7/00

[58] Field of Search ..... 96/56, 22, 60 R, 60 BF

[56] References Cited

UNITED STATES PATENTS

| | | | |
|---|---|---|---|
| 2,515,121 | 7/1950 | Harsh et al. | 96/56 |
| 3,140,177 | 7/1964 | Welch | 96/56 |
| 3,582,322 | 6/1971 | Edens et al. | 96/22 |
| 3,649,277 | 3/1972 | Shibaoka et al. | 96/56 |
| 3,676,136 | 7/1972 | Mowrey | 96/56 |
| 3,706,561 | 12/1972 | Mowrey et al. | 96/60 BF |
| 3,843,367 | 10/1974 | Schranz et al. | 96/56 |

*Primary Examiner*—J. Travis Brown
*Attorney, Agent, or Firm*—Sughrue, Rothwell, Mion, Zinn & Macpeak

[57] ABSTRACT

In a method for developing, bleaching and fixing an exposed silver halide photographic material, the improvement which comprises bleaching the photographic material with a bleaching solution containing a ferric salt, then processing the photographic material with a solution containing an organic acid.

20 Claims, No Drawings

COLOR PHOTOGRAPHIC PROCESSING METHOD

BACKGROUND OF THE INVENTION

1. FIELD OF THE INVENTION

The present invention relates to a color photographic processing method and, more particularly, it relates to a method for preventing formation of stain in color photographic images.

2. DESCRIPTION OF THE PRIOR ART

In the processing of a silver halide color photographic material, a step of removing developed silver from the silver halide emulsion layer or layers (the so-called bleaching step) is included, i.e., a step of removing silver images which are simultaneously formed upon development, so as to leave only dye images formed by the reaction between an oxidation product of a color developing agent and a color coupler or couplers. In such step, a bleaching agent (e.g., ferricyanides, iron(III)-amino-polycarboxylic acid complex salts, ferric salts, etc.) are usually used.

Disclosure has been made that the use of ferric salts provides various advantages. In this case, however, when washing or fixing is conducted subsequent to the bleaching step, stains are formed and, sometimes, a very small amount of silver remains. Since such stains and residual silver deteriorate the commercial value of the images finally obtained, removal or prevention of such is desirable.

SUMMARY OF THE INVENTION

Therefore, an object of the present invention is to provide a color photographic processing method which enables the generation of stains to be prevented.

Another object of the present invention is to provide a color photographic processing method which enables the prevention of silver from remaining after bleaching.

A further object of the present invention is to provide a color photographic processing method which enables excellent dye images to be obtained.

According to extensive experiments, it has been found that the above-described objects can be attained by bleaching a color photographic material with a bleaching solution containing a ferric salt, then processing the photographic material with an organic acid solution. That is, the present invention is an improvement in a method for developing, bleaching and fixing an exposed silver halide color photographic material, and comprises bleaching the photographic material with a bleaching solution containing a ferric salt, and then processing the photographic material in an organic acid-containing bath.

DETAILED DESCRIPTION OF THE INVENTION

The bleaching ability of a ferric salt is extremely effective for photographic bleaching processing. However, the generation of stains and the silver which remains experienced on using ferric salts are believed to be due to ferric salts remaining in a certain form in the processed photographic material. Therefore, the use of an organic acid-containing bath is effective for neutralizing the ferric salts.

The organic acid-containing bath is fundamentally an aqueous solution of an organic acid. The bath can be employed at any step after bleaching, preferably before the fixing step, more preferably between the bleaching step and the fixing step.

Organic acids are generally well known compounds and are preferably water-soluble. Within this definition are included aliphatic carboxylic acids, aromatic carboxylic acids, organic phosphonic acids and the salts thereof.

The most preferred examples of organic acids are the aliphatic carboxylic acids and these acids are preferably those represented by the following general formula (I):

$$R\text{-}COOM \qquad (I)$$

wherein R represents an alkyl group (preferably having 1 to 12 carbon atoms), an alkenyl group (preferably having 1 to 6 carbon atoms), an alkyl group having 1, 2 or more hydroxy groups and/or carboxy groups (preferably having 1 to 12 carbon atoms), or an alkenyl group having 1, 2 or more hydroxy groups and/or carboxy groups (preferably having 1 to 6 carbon atoms), and M represents a hydrogen atom, an ammonium group or an alkali metal atom (such as sodium, potassium, etc.).

Illustrative compounds represented by the above formula are acetic acid, propionic acid, butyric acid, isovaleric acid, caproic acid, capric acid, lauric acid, acrylic acid, crotonic acid, propiolic acid, oxalic acid, malonic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, fumaric acid, citraconic acid, mesaconic acid, itaconic acid, glycollic acid, lactic acid, β-hydroxypropionic acid, tartronic acid, malic acid, oxalacetic acid, tartaric acid, citric acid, and the ammonium salts, sodium salts and potassium salts thereof.

Of these compounds, dicarboxylic acids (e.g., oxalic acid, malonic acid, etc.), hydroxycarboxylic acids (e.g., glycollic acid, tartaric acid, citric acid, etc.), hydroxydicarboxylic acids, and hydroxytricarboxylic acids are particularly preferred.

Other examples of organic acids are the aminopolycarboxylic acids. Aminopolycarboxylic acids have long been known in the art and are described in, e.g., German Pat. No. 866,605, British Pat. Nos. 746,567; 933,008, U.S. Pat. Nos. 3,227,552; 3,582,322; etc. Most preferable aminopolycarboxylic acids are defined by the following general formulae (II) or (III):

$$MOC\overset{O}{\overset{\|}{}}R_1-A-R_2-\overset{O}{\overset{\|}{C}}-OM \qquad (II)$$

$$\begin{array}{l} \quad\;\; O \\ \quad\;\; \| \\ MO-C-R_3-N-R_4-W \\ \qquad\qquad\;\; | \\ \quad\;\; O \quad\;\; R_5 \quad\;\; O \\ \quad\;\; \| \quad\;\; | \quad\;\; \| \\ MO-C-R_3-N-R_4-C-OM \end{array} \qquad (III)$$

wherein A represents a hydrocarbyl group, an oxygen atom, a sulfur atom or an $=NR_6$ group ($R_6$ being a hydrogen atom or a substituted or unsubstituted hydrocarbyl group), $R_1$, $R_2$, $R_3$, $R_4$ and $R_5$ each represents a substituted or unsubstituted hydrocarbyl group, W represents a carboxyl group (—COOM) or a hydroxyalkyl group (preferably having 1 to 4 carbon atoms), and M represents a hydrogen atom, an alkali metal atom, an ammonium group (e.g., unsubstituted or a water-soluble amine group).

These aminopolycarboxylic acids can be used in the form of an alkali metal salt (such as the sodium and potassium salt), an ammonium salt or a water-soluble amine salt, e.g., a substituted amine group substituted with an alkyl group having 1 to 4 carbon atoms or a hydroxy alkyl group having 1 to 4 carbon atoms. Examples of these aminopolycarboxylic acids and suitable substituents thereof are disclosed in U.S. Pat. No. 3,582,322.

The most representative examples of the aminopolycarboxylic acids represented by the above general formula are illustrated below:

Ethylenediaminetetraacetic acid,
Disodium ethylenediaminetetraacetate,
Diammonium ethylenediaminetetraacetate,
Tetra(trimethylammonium)ethylenediaminetetraacetate,
Tetrapotassium ethylenediaminetetraacetate,
Tetrasodium ethylenediaminetetraacetate,
Trisodium ethylenediaminetetraacetate,
Diethylenetriaminepentaacetic acid,
Pentasodium diethylenetriaminepentaacetate,
Ethylenediamine-N-(β-hydroxyethyl)-N,N',N'-triacetic acid,
Sodium ethylenediamine-N-(β-hydroxyethyl)-N,N',-N'-triacetate,
Triammonium ethylenediamine-N-(β-hydroxyethyl)-N,N',N'-triacetate,
Propylenediaminetetraacetic acid,
Sodium propylenediaminetetraacetate,
Nitrilotriacetic acid,
Sodium nitrilotriacetate,
Cyclohexanediaminetetraacetic acid,
Sodium cyclohexanediaminetetraacetate,
Iminodiacetic acid,
Dihydroxyethylglycine,
Ethyletherdiaminetetraacetic acid,
Glycoletherdiaminetetraacetic acid,
Ethylenediaminetetrapropionic acid, or
Phenylenediaminetetraacetic acid.

Additional examples of organic acids are the organic phosphonic acids. Organic phosphonic acids are well known compounds and, of these, the aminopolymethylenephosphonic acids (or the water-soluble salts thereof) are effective. The aminopolymethylenephosphonic acids are represented by the following general formula (IV):

$$R_7N(CH_2PO_3M'_2)_2 \qquad (IV)$$

wherein M' represents a hydrogen atom or a cation capable of providing water-solubility (e.g., alkali metals such as sodium, potassium, etc.; ammonium; pyridinium; triethanolammonium; trimethylammonium ion; and the like); and $R_7$ represents an alkyl group having 1 to 4 carbon atoms (e.g., methyl, ethyl, propyl, isopropyl, butyl, etc.), an aryl group (e.g., phenyl, o-tolyl, m-tolyl, p-tolyl, p-carboxyphenyl, water-soluble salt of p-carboxyphenyl group (e.g., sodium salt, potassium salt, etc.), an aralkyl group (e.g., a benzyl group, a β-phenethyl group, an o-acetamidobenzyl group, etc., particularly, those having 7 to 9 carbon atoms), an alicyclic group (e.g., a cyclohexyl group, a cyclopentyl group, etc.), or a heterocyclic group (e.g., a pyrrolidylmethyl group, a pyrrolidylbutyl group, a benzothiazoylmethyl group, a tetrahydroquinolylmethyl group, etc.). $R_7$ can be substituted (this is particularly desirable when $R_7$ represents an alkyl group) with a hydroxy group, an alkoxy group (e.g., a methoxy group, an ethoxy group, etc.), a halogen atom (e.g., a chlorine atom, etc.), $-PO_3M'_2$, $-CH_2PO_3M'_2$, $-N(CH_2PO_3M'_2)_2$ or the like, with M' being the same as defined above.

Examples of phosphonic acids represented by the general formula (IV) include:

Ethylenediamine-N,N,N',N'-tetramethylenephosphonic acid,
Nitrilo-N,N,N-trimethylenephosphonic acid,
1,2-Cyclohexanediamine-N,N,N',N'-tetramethylenephosphonic acid,
o-Carboxyaniline-N,N-dimethylenephosphonic acid,
Propylamine-N,N-dimethylenephosphonic acid,
4-(N-Pyrrolidino)butylamine-N,N-bis(methylenephosphonic acid),
1,3-Diaminopropanol-N,N,N',N'-tetramethylenephosphonic acid,
1,3-Propanediamine-N,N,N',N'-tetramethylenephosphonic acid,
1,6-Hexanediamine-N,N,N',N'-tetramethylenephosphonic acid,
o-Acetamidobenzylamine-N,N-dimethylenephosphonic acid,
o-Toluidine-N,N-dimethylenephosphonic acid,
2-Pyridylamine-N,N-dimethylenephosphonic acid,
and the like.

As other examples of organic phosphonic acids, there are those compounds represented by the following general formula (V):

$$R_8R_9C(PO_3M'_2)_2 \qquad (V)$$

wherein $R_8$ represents a hydrogen atom or the above-defined alkyl group, aralkyl group, alicyclic group, heterocyclic group or $-PO_3M'_2$; and $R_9$ represents a hydrogen atom, a hydroxy group, an alkyl group having 1 to 4 carbon atoms, the above-defined substituted alkyl group or $-PO_3M'_2$ with M' being the same as defined above.

Examples of compounds represented by the general formula (V) include:

1-Hydroxyethylidene-1,1-diphosphonic acid,
Ethylidyne-1,1,1-triphosphonic acid,
1-Hydroxy-2-phenylethylidene-1,1-diphosphonic acid, and the like.

These organic phosphonic acids are described in U.S. Pat. No. 3,617,282.

These organic acids can be used alone or in combination and are generally used in an amount of about 0.1 to 400 g/l, particularly, preferably 1 to 200 g/l.

The organic acid-containing bath (the stain-preventing bath) can further contain inorganic salts such as carbonates, phosphates, borates, hydroxides, etc.

The bleaching solution in the present invention designates a solution which contains a ferric salt as a bleaching component. The term ferric salt as used herein designates a water-soluble ferric salt and includes, e.g., ferric chloride, ferric sulfate, ferric nitrate, ferric bromide, ferric phosphate, ferric perchlorate, ammonium ferric sulfate, ferric citrate, ferric oxalate, ferric acetate, etc. The ferric salt oxidizes metallic silver, and is reduced to a ferrous salt. Since the bleaching solution is used as an aqueous solution, the ferric salts are desirably water-soluble. Therefore, any ferric salt that satisfies this condition can be used. Suitable bleaching solutions and the components and amounts therein are disclosed in U.S. Pat. No. 3,582,322.

In general, the bleaching solution is acidic and, particularly, has a pH of 3 or lower (most preferably, a pH of not more than 2). For this purpose, the solution contains a mineral acid and/or an organic acid. In particular, it is preferable for the bleaching solution to contain an organic acid from the standpoint of bleaching action. The organic acid in this respect is the same as described above with respect to the stain preventing bath, and aliphatic carboxylic acids and organic phosphonic acids are particularly preferable. On the other hand, mineral acids include hydrochloric acid, sulfuric acid, nitric acid, phosphoric acid, hydrobromic acid, chloric acid, etc.

The bleaching solution can contain various photographic additives. It is particularly preferable for the bleaching solution to contain a re-halogenating agent. Examples of re-halogenating agents are alkali metal halides (particularly alkali metal bromides) and ammonium halides (particularly ammonium bromides). Specific examples thereof include, e.g., potassium bromide, sodium bromide, sodium chloride, ammonium bromide, etc. This rehalogenating agent is incorporated in the bleaching solution in an amount of about 20 to 300 g, particularly 50 to 200 g, per 1 l of the bleaching solution.

Furthermore, additives which are known in the art and added to a bleaching solution or a bleach-fixing solution can be incorporated in the bleaching solution. Such additives include nitrates (e.g., sodium nitrate, etc.), sulfites, mercapto compounds (e.g., mercaptotriazole, etc.), pH buffers (e.g., borate, oxalate, acetate, carbonate, phosphate, etc.), stain-preventing agents (e.g., formamidinosulfinic acid, etc.), the polyamine compounds as described in Japanese Patent Publication No. 8836/70, etc., the alkylamine compounds as described in British Pat. No. 1,192,481, etc., the polyethylene oxides as described in German Pat. No. 966,410, etc., the nitrogen-containing heterocyclic compounds as described in German Pat. No. 1,290,812, and the like.

The method of the present invention includes the individual steps of development, bleaching and fixing. These steps and suitable processing solutions which can be employed are disclosed in U.S. Pat. No. 3,582,322. More specifically development preferably means color development but, in some cases, means black-and-white development or both black-and-white development and color development. The above-described three steps need not necessarily be conducted continuously, and other steps can be conducted before and after each step. Such additional steps include subjecting the material to a stopping bath, an image-stabilizing bath, a hardening bath, a neutralizing bath, a washing (including rinsing), and the like. In some cases, a bleaching step and a fixing step can further be added.

The color developer used in the method of the present invention is an aqueous alkaline solution of a known aromatic primary amine color developing agent and preferably contains benzyl alcohol in an amount of not less than 1 g per liter or, in some cases, less than 1 g per liter. Examples of color developing agents are phenylenediamine derivatives such as N,N-diethyl-p-phenylenediamine sulfate, 4-amino-N-ethyl-N-β-hydroxyethylaniline sulfate, 3-methyl-4-amino-N-ethyl-β-methanesulfoamidoethylaniline sesquisulfate monohydrate, 3-methyl-4-amino-N-ethyl-N-β-hydroxyethylaniline sulfate, 3-methyl-4-amino-N,N-diethylaniline hydrochloride, and the like. Furthermore, known additives for the developer, such as an alkali metal salt sulfite, a carbonate, a bisulfite, a bromide, an iodide, an antifogging agent, a development accelerator, a solvent (e.g., diethyl glycol, etc.), and the like, can be incorporated in the developer.

In the case of developing a color coupler-free color photographic light-sensitive material, a color developer containing a color coupler is used (e.g., as described in U.S. Pat. Nos. 2,252,718; 2,592,243; 2,590,970; etc.).

On the other hand, in the case of applying the method of the present invention to black-and-white development, an alkaline aqueous solution containing hydroxybenzenes (e.g., hydroquinone, chlorohydroquinone, bromohydroquinone, isopropylhydroquinone, toluhydroquinone, methylhydroquinone, 2,3-dichlorohydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-aminopyrazolines (e.g., 1-p-hydroxyphenyl)-3-aminopyrazoline, 1-(p-methylaminophenyl)-3-pyrazoline, 1-(p-aminophenyl)-3-aminopyrazoline, 1-(p-amino-m-methylphenyl)-3-aminopyrazoline, etc.), mixture thereof or like developing agents is used. Both the black-and-white developer and the color developer have a pH of about 9 to 13, preferably 10 to 12.5.

The steps which can be conducted after the bleaching step include a fixing bath, an image-stabilizing bath, and washing (or rinsing) which can be conducted before and after these steps.

In the fixing step, any of the conventional fixing solutions thus far known can be used. That is, as the fixing agent, an ammonium, sodium or potassium thiosulfate is used in an amount of about 50 to 200 g/l. The fixing solution can further contain a stabilizing agent (e.g., a sulfite, a metabisulfite, etc.), a hardening agent (e.g., potassium alum, etc.), a pH buffer (e.g., an acetate, a borate, etc.), and the like. The fixing solution generally has a pH of not less than about 3.

As to the image-stabilizing bath, the methods described in U.S. Pat. Nos. 2,515,121; 2,518,686; 3,140,177; etc., can be employed.

Where the above-described three additional steps are designed to perform the function of the stain-removing bath of the present invention, the pH of each bath is adjusted to the alkaline side.

The photographic light-sensitive materials to which the method of the present invention is applicable contain at least one silver halide emulsion layer. The silver halide emulsion is an emulsion prepared by dispersing a silver halide such as silver chloride, silver iodide, silver bromide, silver chlorobromide, silver bromoiodide or silver chlorobromoiodide in a hydrophilic colloid (binder). Examples of hydrophilic colloids are, e.g., gelatin, colloidal albumin, casein, cellulose derivatives (e.g., carboxymethyl cellulose, hydroxyethyl cellulose, etc.), polysaccharides (e.g., agar-agar, sodium alginate, starch derivatives, etc.), synthetic hydrophilic colloids (e.g., polyvinyl alcohol, poly-N-vinylpyrrolidone, polyacrylic acid copolymers, polyacrylamide, derivatives thereof, etc.), and the like. If desired, a compatible mixture of two or more of these colloids can be used. Of these, gelatin is used most commonly. A part or all of the gelatin can be replaced by a synthetic high molecular weight substance, or replaced by a so-called gelatin derivative, i.e., that prepared by treating gelatin with a reagent having a group capable of reacting with the functional groups contained in the gelatin molecule (i.e., the amino groups, imino groups, hydroxy groups, or carboxy groups), or a graft polymer prepared by grafting a molecular chain of another high molecular weight substance to gelatin. As the reagents for preparing the gelatin derivatives, there are illustrated, e.g., the isocyanates, acid chlorides and acid anhydrides as described in U.S. Pat. No. 2,614,928, the acid anhydrides as described in U.S. Pat. No. 3,118,766, the bromoacetic acids described in Japanese Patent Publication No. 5514/64, the phenyl glycidyl ethers as described in Japanese Patent Publication No. 26845/67, the vinylsulfone compounds as described in U.S. Pat. No. 3,132,945, the N-allylvinylsulfonamides as described in British Pat. No. 861,414, the maleinamide compounds as described in U.S. Pat. No. 3,186,846, the acrylonitriles as described in U.S. Pat. No. 2,594,293, the polyalkylene oxides described in U.S. Pat. No. 3,312,553, the epoxy compounds described in Japanese Patent Publication No. 26845/67, the acid esters as described in U.S. Pat. No. 2,763,639, the alkansultones described in British Pat. No. 1,033,189, and the like. As the high molecular weight compounds to be grafted to gelatin as a branch, many descriptions are given in U.S. Pat. Nos. 2,763,625; 2,831,767; 2,956,884; *Polymer Letters*, 5, 595 (1967), *Phot. Sci. Eng.*, 9, 148 (1965), *J. of Polymer Sci.*, A-1, 9, 3199 (1971), and the like. In general, homopolymers or copolymers of those monomers called vinyl monomers, such as acrylic acid, methacrylic acid, derivatives thereof (e.g., esters, amides, nitriles, etc.), styrene and the like are widely used. Of these, hydrophilic vinyl polymers having some compatability with gelatin, such as the homopolymers or copolymers of acrylic acid, acrylamide, methacrylamide, hydroxyalkyl acrylate, hydroxyalkyl methacrylate, etc., are particularly desirable.

The silver halide emulsions can be prepared using methods well known in the art (e.g., a single jet method, a double jet method, a controlled jet method, etc.) by mixing a water-soluble silver salt (e.g., silver nitrate, etc.) with a water-soluble halide in the presence of water and a hydrophilic colloid, followed by physical ripening and chemical ripening (e.g., gold sensitization and/or sulfur sensitization, etc.).

To the silver halide emulsion can be added, during the production step thereof or immediately before coating, a spectral sensitizer (e.g., a cyanine dye, a merocyanine dye, or a mixture thereof as disclosed in, e.g., U.S. Pat. Nos. 2,493,748; 2,519,001; 2,977,229; 3,480,434; 3,672,897; 3,703,377; 2,688,545; 2,912,329; 3,397,060; 3,615,635; 3,628,964; 3,522,052; 3,527,641; 3,615,613; 3,515,632; 3,617,295; 3,635,721; 3,694,217; etc.), a stabilizing agent (e.g., 4-hydroxy-6-methyl-1,3,3a,7-tetrazaindene, etc.), a sensitizing agent (e.g., the compounds described in U.S. Pat. No. 3,619,198), an antifogging agent (e.g., benzotriazole, 5-nitrobenzimidazole, etc.), a polyethylene oxide, a hardener (e.g., aldehyde compounds such as formaldehyde, glyoxal, etc.; non-aldehyde compounds such as mucochloric acid, 2-hydroxy-4,6-dichloro-s-triazine, etc., as disclosed in, e.g., U.S. Pat. Nos. 3,288,775; 2,732,303; 3,635,718; 3,232,763; 2,732,316; 2,586,168; 3,103,437; 3,017,280; 2,983,611; 2,725,294; 2,725,295; 3,100,704; 3,091,537; 3,321,313; 3,543,292; etc.), a coating aid (e.g., saponin, sodium lauryl sulfate, dodecylphenol polyethyleneoxide ether, hexadecyltrimethylammonium bromide, etc.), and the like.

The silver halide contained in the thus obtained emulsion is preferably has a mean grain size of about 0.2 to 1.5$\mu$.

Where the method of the present invention is applied to the system in which a color coupler or couplers are incorporated in the light-sensitive material (e.g., as disclosed in U.S. Pat. Nos. 2,376,679; 2,322,027 and 2,801,171), at least one silver halide emulsion layer can contain a color coupler (i.e., a compound capable of reacting with an oxidation product of a color developing agent to form a dye). Suitable color couplers which can be used are disclosed in the following U.S. Patents, e.g., cyan couplers; U.S. Pat. Nos. 2,474,293; 2,698,794; 3,034,892; 3,214,437; 3,253,924; 3,311,476; 3,458,315; 3,582,322; 3,591,383; etc., magenta couplers; U.S. Pat. Nos. 2,600,788; 2,983,608; 3,006,759; 3,062,653; 3,214,437; 3,253,924; 3,311,476; 3,337,344; 3,419,391; 3,419,808; 3,476,560; 3,582,322; etc., yellow couplers; U.S. Pat. Nos. 3,277,157; 3,415,652; 3,447,928; 3,311,476; 3,408,194; 2,875,057; 3,265,506; 3,409,439; 3,551,157; 3,551,156; 3,582,322; etc.

Usually, in color photography, cyan, magenta and yellow color couplers are used. That is, as the cyan color former, any of those which contain a naphthol or phenol structure as a fundamental structure and can form an indoaniline dye upon coupling can be used. As the magenta color coupler, any of those which contain a 5-pyrazolone ring having an active methylene group as a fundamental skeleton can be used. As the yellow color coupler, any of those which contain a benzoylacetanilide structure, a pivalylacetanilide structure or an acylacetanilide structure, having an active methylene group, with or without a substituent at the coupling position, can be used. This is because the bleaching solution of the present invention has sufficient oxidizing ability to sufficiently enhance the color density.

The pyrazolone-type color couplers can be represented by the following general formula:

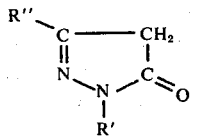

wherein R′ represents a substituted or unsubstituted alkyl group, a substituted or unsubstituted aryl group or a substituted or unsubstituted heterocyclic group, and R″ represents an alkyl group, a carbamyl group, an amino group or an amido group.

Specific examples of these compounds include:

1-p-sec-Amylphenyl-3-n-amyl-5-pyrazolone,
2-Cyanoacetyl-5-(p-sec-amylbenzoylamino)coumarone, 2-Cyanoacetylcoumarone-5-(N-n-amyl-p-t-amylsulfoanilide)
2-Cyanoacetylcoumarone-5-sulfon-N-n-butylanilide,
1p-Laurylphenyl-3-methyl-5-pyrazolone,
1-$\beta$-Naphthyl-3-amyl-5-pyrazolone,
1p-Nitrophenyl-3-n-amyl-5-pyrazolone,
1-Phenyl-3-acetylamino-5-pyrazolone,
1-Phenyl-3-n-valerylamino-5-pyrazolone,
1-Phenyl-3-chloroacetylamino-5-pyrazolone,
1-Phenyl-3-(m-aminobenzoyl)-amino-5-pyrazolone, 1-p-Phenoxyphenyl-3-(p-t-amyloxybenzoyl)-amino-5-pyrazolone,
1-(2',4',6'-Trichlorophenyl)-3-benzamido-5-pyrazolone,
1-(2',4'-Dichlorophenyl)-3-[3''-(2''',4'''-di-t-amylphenoxyacetamido)benzamido]-5-pyrazolone,
1-(2,4-Dimethyl-6-chlorophenyl)-3-[3''-(2''',4'''-di-t-amylphenoxyacetamido)benzamido]-5-pyrazolone, etc.

Furthermore, the following couplers can be used:
1-(2',4',6'-Trichlorophenyl)-3-(2''-chloro-5''-tetradecaneamidoanilino)-5-pyrazolone,
1-(2',4',6'-Trichlorophenyl)-3-(2''-chloro-5''-[N-3'''-(2'''',5''''-di-t-pentylphenoxy)propyl]sulfamoylanilino)-5-pyrazolone,
1-(2',4',6'-Trichlorophenyl)-3-(2''-chloro-4''-tetradecyloxycarbonylanilino)-5-pyrazolone,
1-(2',6'-Dichloro-4'-tetradecyloxycarbonylphenyl)-3-(2,4-dichloroanilino)-5-pyrazolone,
1-(2',4',6'-Trichlorophenyl)-3-{2''-chloro-5''-[2'''-(3''''-t-butyl-4''''-hydroxyphenoxy)tetradecaneamido]anilino}-5-pyrazolone,
1-(2',4',6'-Trichlorophenyl)-3-(2''-chloro-5''-tetradecaneamidoanilino)-5-pyrazolone,
1-(2',4',6'-Trichlorophenyl)-3-{3''-[α-2''',4'''-di-t-pentylphenoxy)acetamido]benzamido}-5-pyrazolon-4-yl benzyl carbonate,
1-(2',4',6'-Trichlorophenyl)-3-{3''-(3'''-pentadecylphenoxy)butyramido]benzamido}-5-pyrazolon-4-yl ethyl carbonate,
1-(2',4',6'-Trichlorophenyl)-3-{2''-chloro-5''-[γ-(2''',4'''-di-t-pentylphenoxy)propylsulfamoyl-]anilino}-5-pyrazolon-4-yl benzyl carbonate,
and the like.

Also, the color formers described in British Pat. No. 1,143,553, U.S. Pat. Nos. 3,337,344 and 3,582,322 can be used.

As the examples of 4-equivalent color formers capable of providing yellow dyes, such as the color couplers of the benzoylacetanilide type or the pivaloylacetanilide type, those described in British Pat. No. 1,113,038, U.S. Pat. Nos. 3,337,344 and 3,582,322 and the following compounds are suitable.

α-{3-[α-m-Pentadecylphenoxy)butyramido]benzoyl}-2-chloroacetanilide,
α- 3-[α-2,4-Di-t-amylphenoxy)butyramido]benzoyl -2-methoxyacetanilide,
α-{3-[α-2,4-Di-t-amylphenoxy)acetamido]benzoyl}-2-chloroacetanilide,
2-Chloro-3'-[4-(2,4-di-t-amylphenoxy)butyramido]-benzoylacetanilide,
α- 3-[α-2,4-Di-t-amylphenoxy)acetamido]benzoyl-benzoylacetanilide,
α-Pivalyl-2,5-dichloro-4-[N'-(n-octadecyl)-N'-methylsulfamyl]acetanilide.

The above compounds are given to illustrate 4-equivalent type yellow color couplers capable of being incorporated in a photographic material to which the present invention is applicable. Of course, the present invention is not limited only to the above-described color couplers. As is different from 2-equivalent type color couplers, these color couplers tend to be insufficiently colored in a bleach-fixing solution since, upon formation of dyes through the coupling reaction, the dyes are formed via a comparatively stable leuco type compound. However, the processing step of the present invention enables sufficient color to be formed even from these color couplers and markedly reduces the difficulty with respect to the discharge of harmful substances.

It is needless to say that light-sensitive materials containing the generally known 2-equivalent color coupler or couplers can be processed according to the method of the present invention. As such color couplers, there are those described in U.S. Pat. Nos. 3,582,322 and the following compounds:

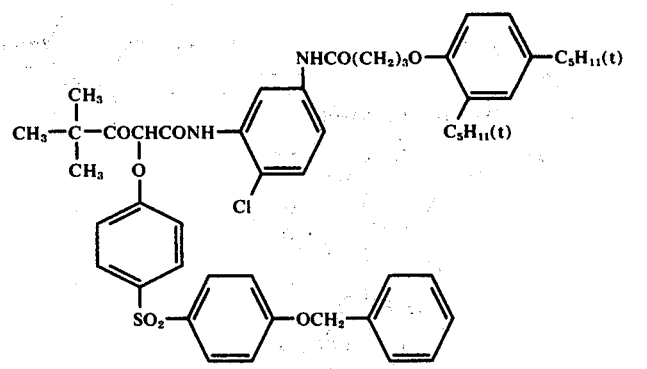

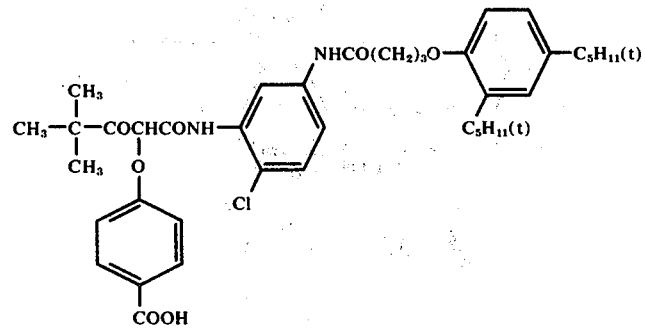

-continued
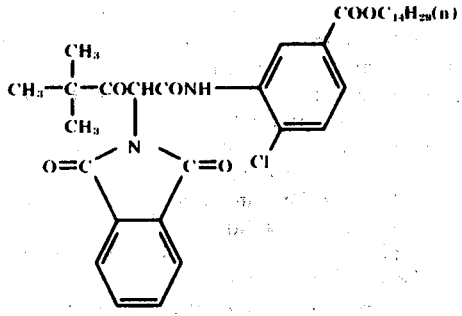
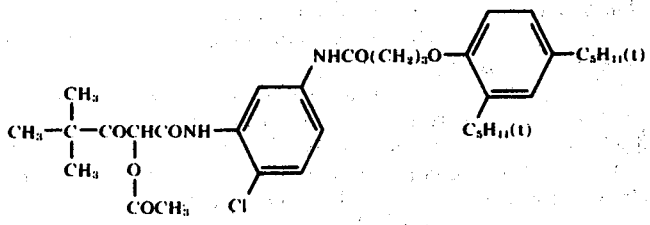
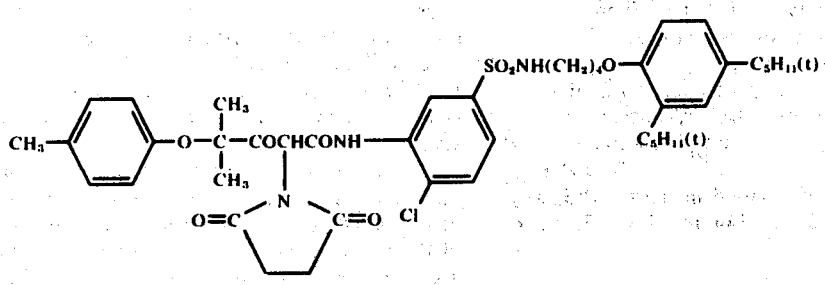
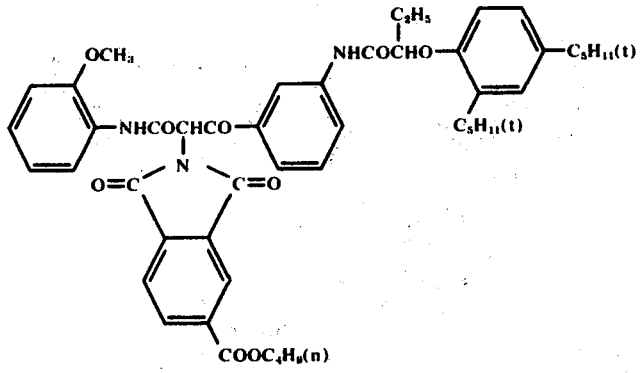
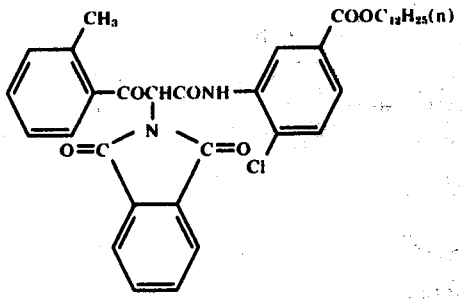

-continued
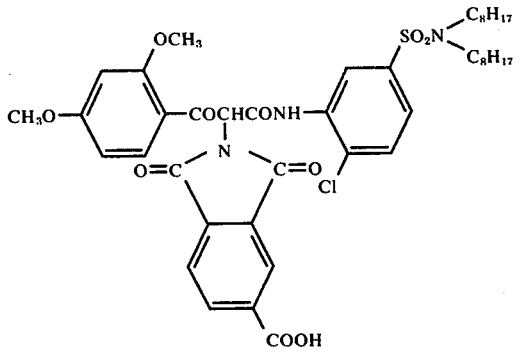
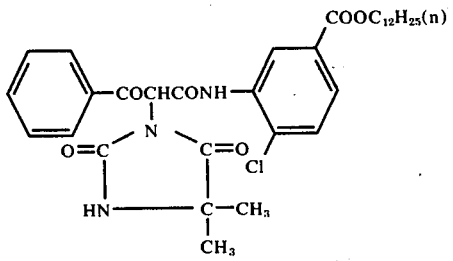
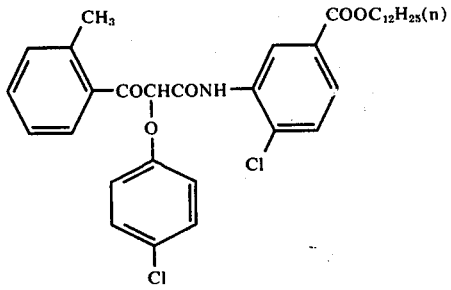
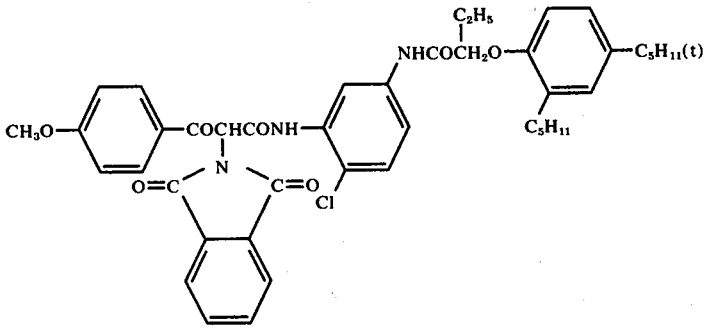
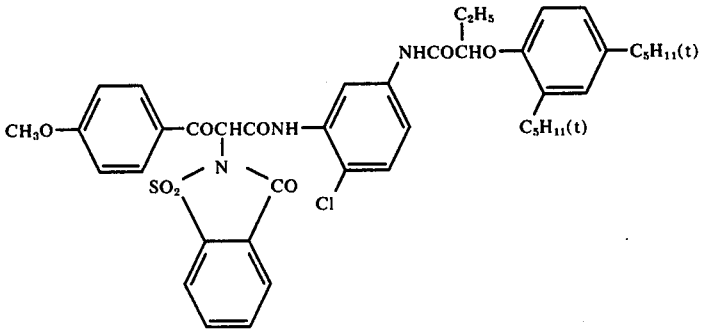

-continued
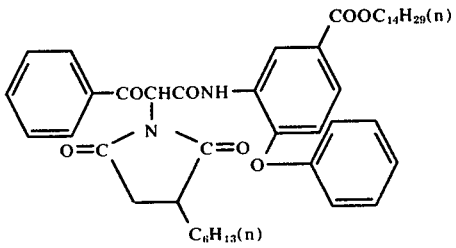
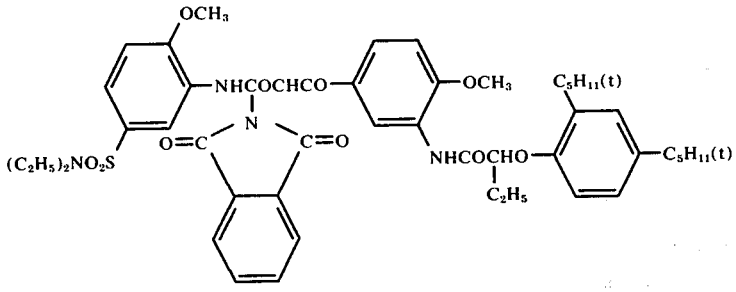
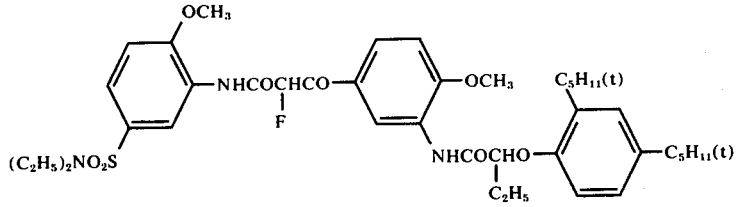
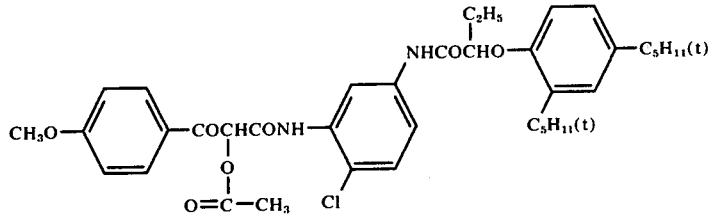
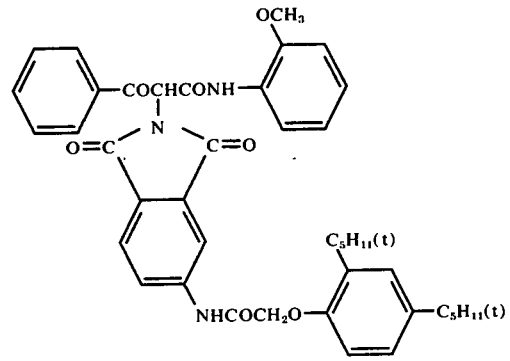
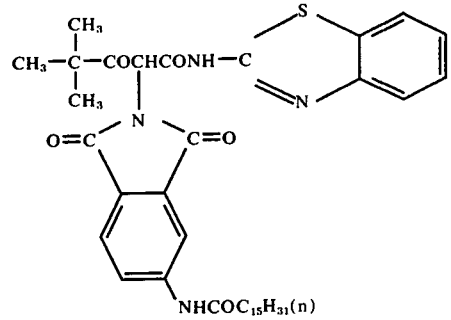

-continued
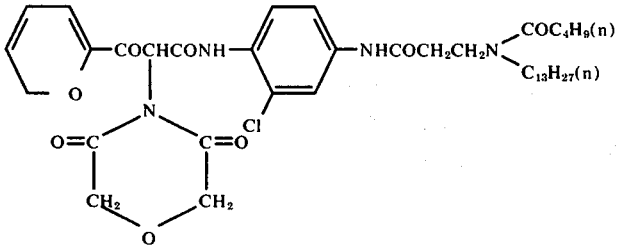
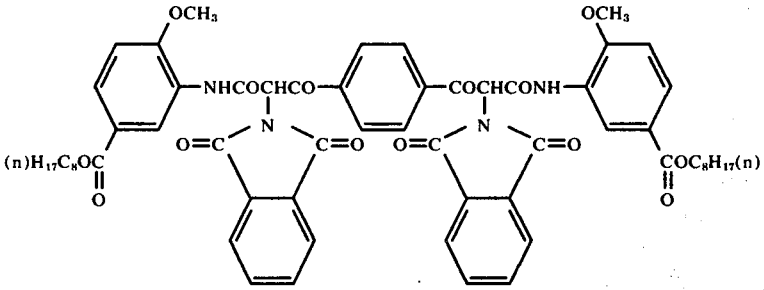
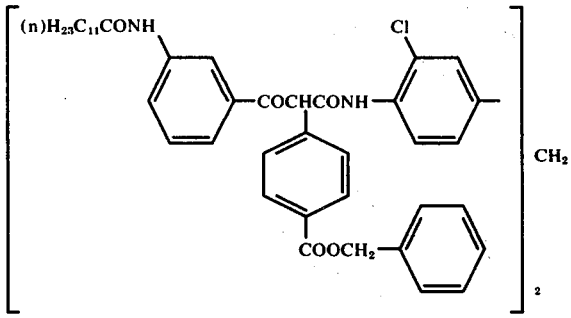
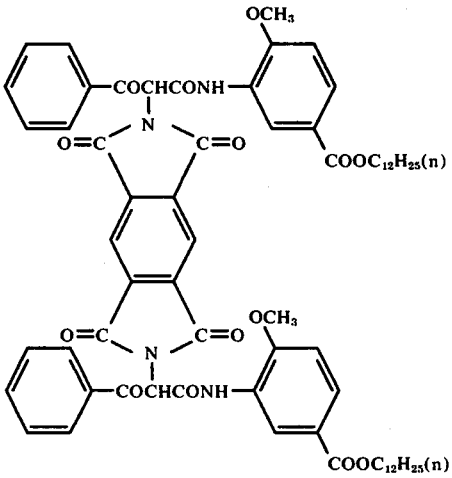
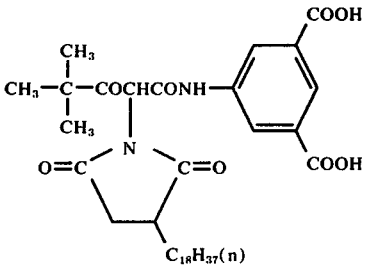

-continued
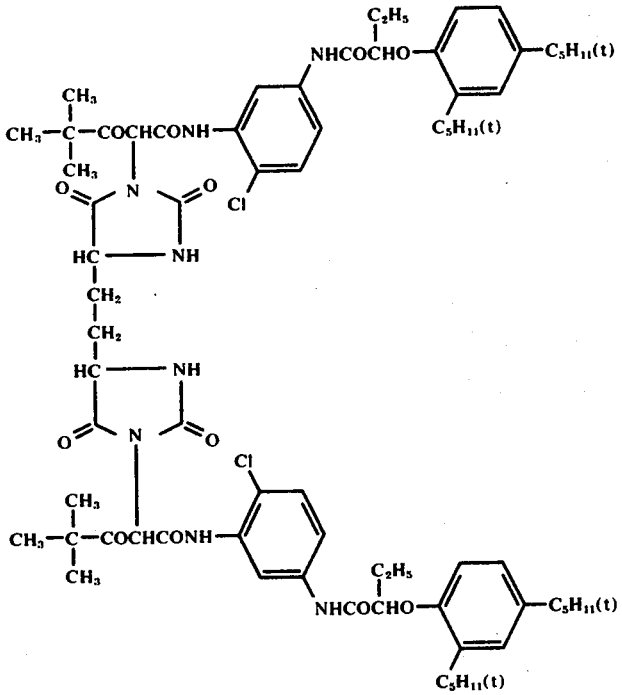
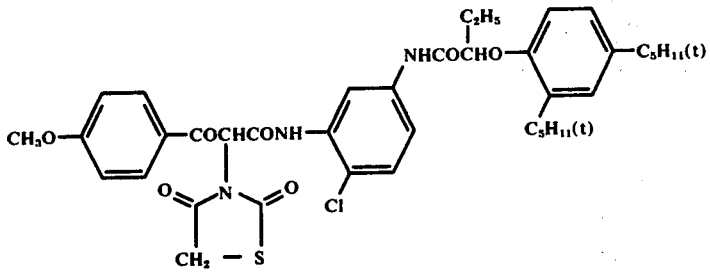
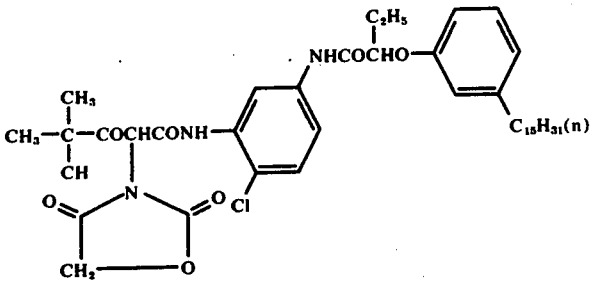
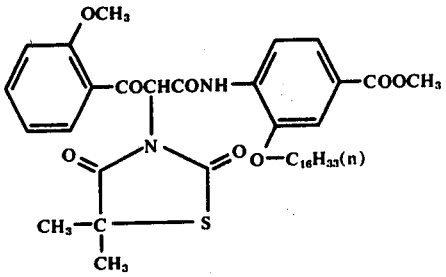

-continued
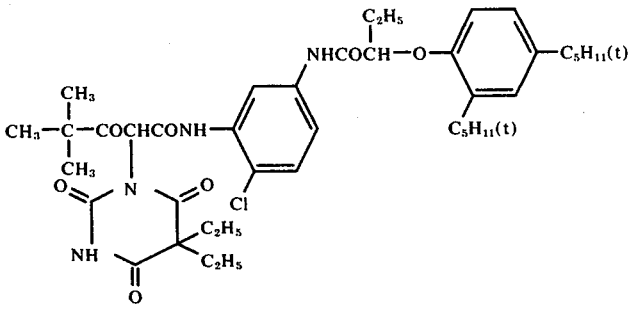
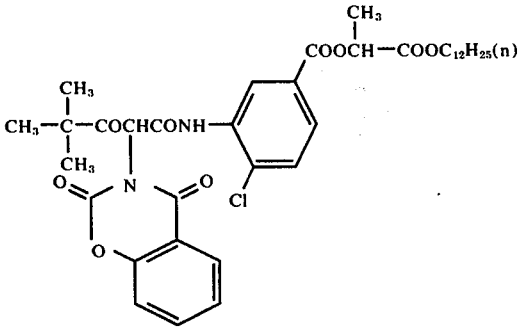
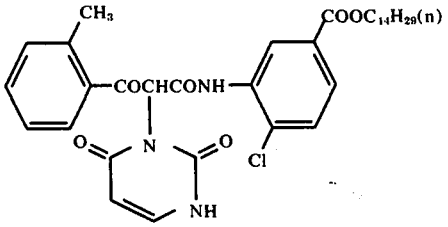
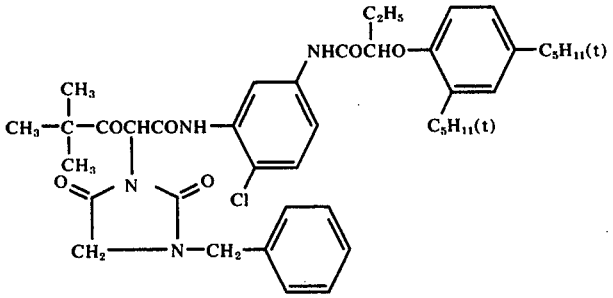
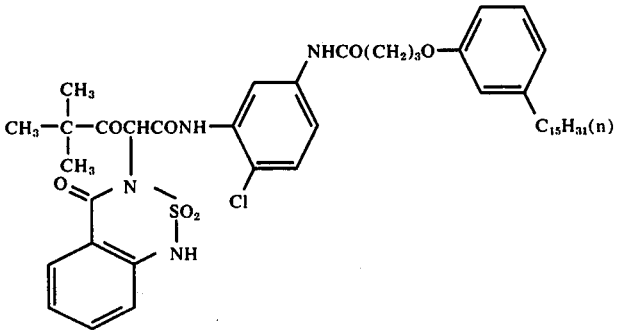

-continued
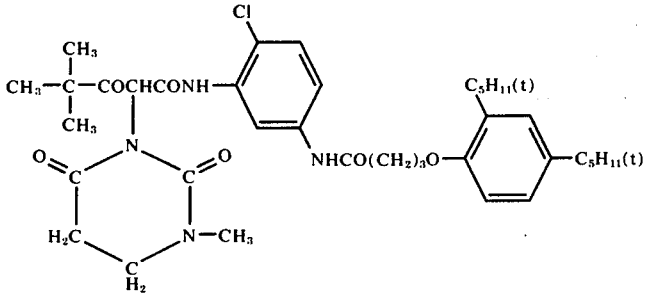
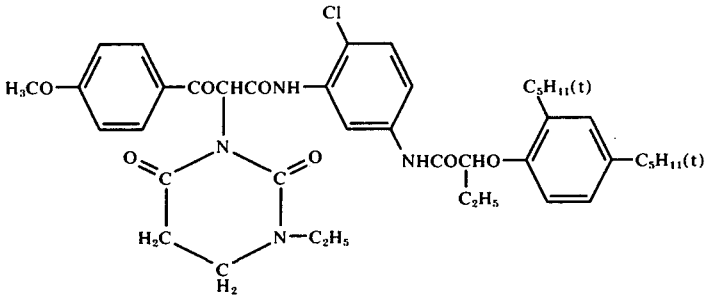
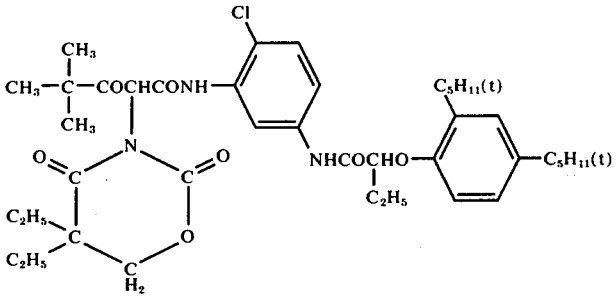
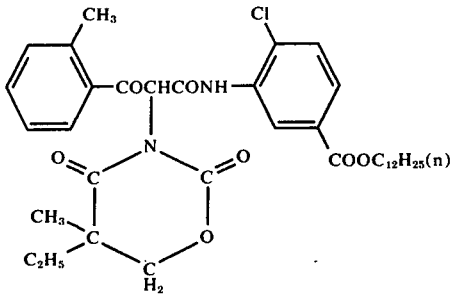
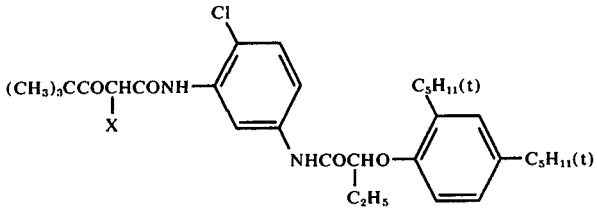
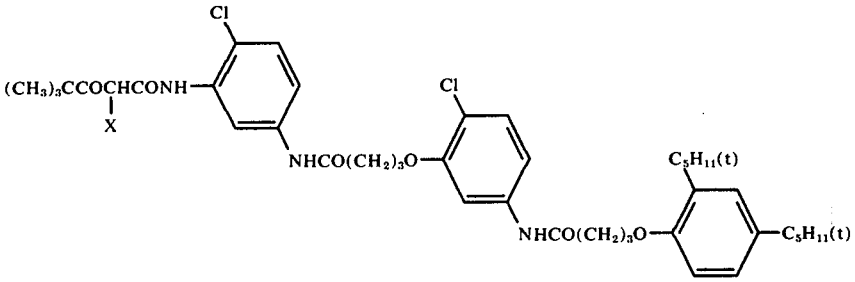

-continued
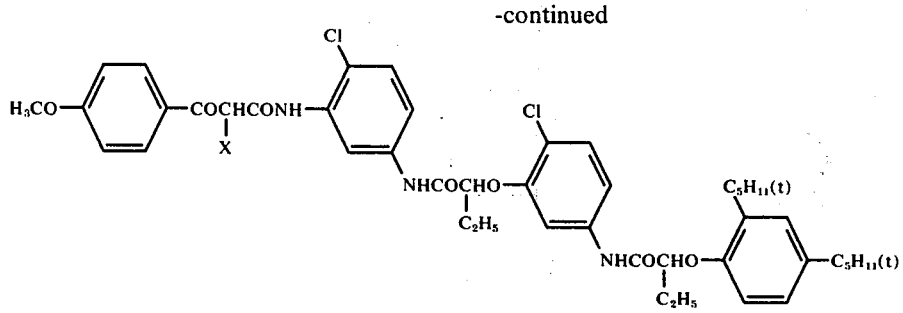
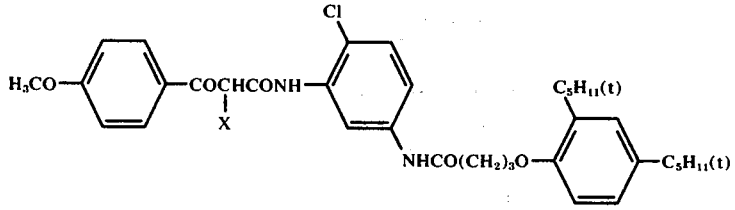
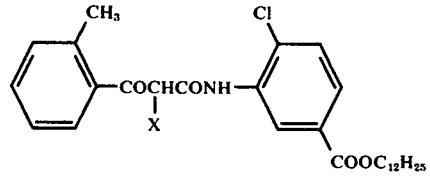
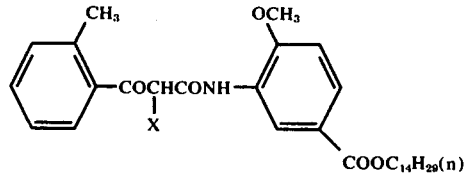
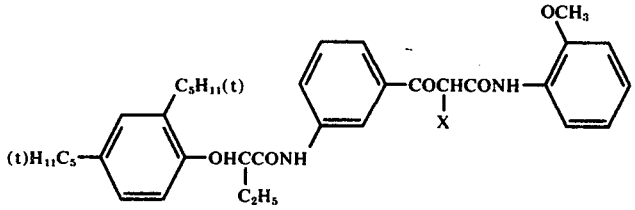
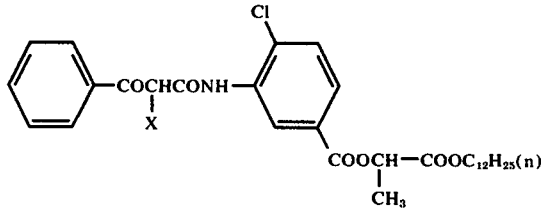
In the above-illustrated compounds, X represents a coupling off group including the following in addition to the aforesaid ones:
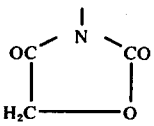
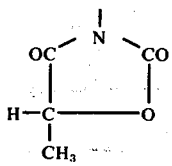
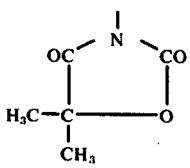

-continued
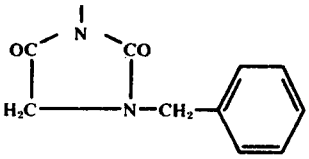
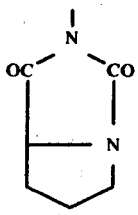
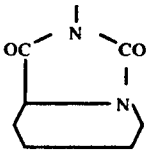
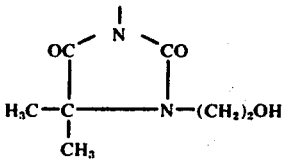
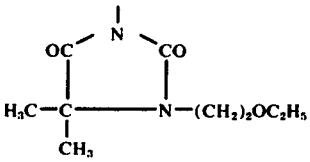
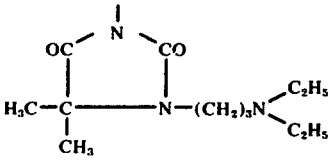
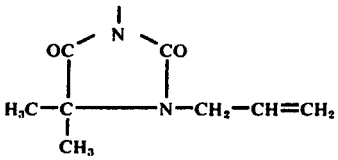
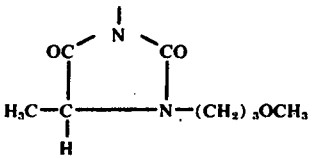
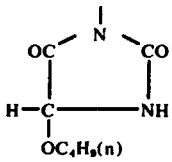
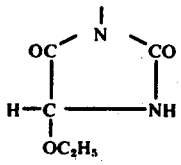
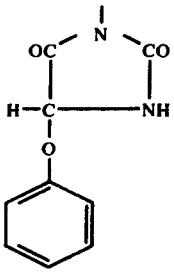
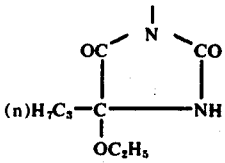

-continued

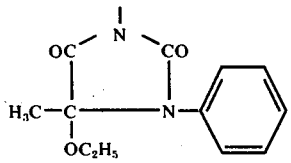

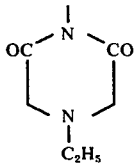

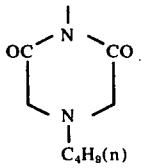

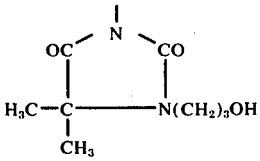

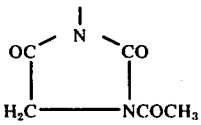

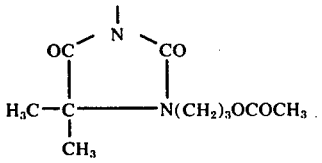

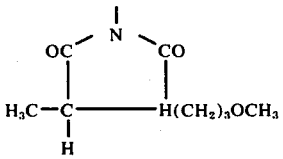

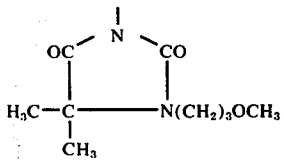

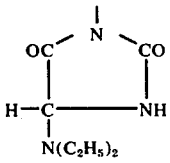

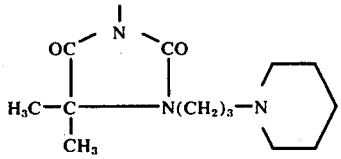

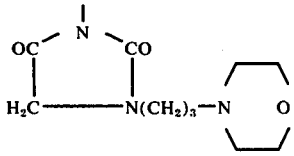

These couplers can be synthesized by conventional methods as described, for example, in U.S. Pat. Nos. 3,277,155 and 3,408,194; German Pat. (OLS) No. 2,057,941; U.S. Pat. No. 2,350,138; No. 2,359,332; No. 2,407,210; No. 2,875,057; No. 3,265,506; No. 3,341,331; No. 3,409,439; No. 3,551,155; No. 3,551,156 and No. 3,649,279; British Pat. No. 1,261,156 and U.S. Pat. No. 1,296,411.

Suitable examples of magenta dye forming couplers are disclosed in the hereinbefore described U.S. Patents.

Examples of cyan dye forming couplers are disclosed in the hereinbefore cited U.S. Patents and include the following specific examples:

5-(p-Amylphenoxybenzenesulfoamino)-1-naphthol,
5-(N-Benzyl-N-naphthalenesulfoamino)-1-naphthol,
5-(N-Benzyl-N-n-valerylamino)-1-naphthol,
5-Caproylamino-1-naphthol,
2-Chloro-5-(p-nitrobenzoyl-β-o-hydroxyethylamino)-1-naphthol,
2-Chloro-5-palmitylamino-1-naphthol,
2,2′-Dihydroxy-5,5′-dibromostilbene,
5-Diphenylethersulfoamido-1-naphthol,
1-Hydroxy-2-(N-sec-amylphenyl)naphthamide,
5-Phenoxyacetamino-1-naphthol,
Monochloro-5-(N-γ-phenylpropyl-N-p-sec-amylbenzoylamino)-1-naphthol,
2-Acetylamino-5-methylphenol,
2-Benzoylamino-3,5-dimethylphenol,
1-Hydroxy-2-[α-(2,4-di-t-amylphenoxy-n-butyl]-naphthamide,
2-(4″-t-Amyl-3′-phenoxybenzoylamino)phenol, etc.

Furthermore, there are illustrated the compounds described in U.S. Pat. No. 3,582,322.

The thus prepared silver halide emulsion is coated on a support such as a glass plate, a baryta paper, a resin-coated paper, a cellulose acetate film, a polyethylene terephthalate film or the like using a dip coating method, an air knife coating method, a bead coating method, an extrusion doctor method, or a both sides coating method, followed by drying.

The thus coated emulsion layer of a silver halide photographic light-sensitive material preferably comprises three layers, i.e., a blue-sensitive emulsion layer, a green-sensitive emulsion layer and a red-sensitive emulsion layer. At least one of the above-described layers can comprise, in some cases, two or more layers. For example, the green-sensitive layer can comprise a highly sensitive layer and a less sensitive layer. In addition, if desired, a protective layer (an uppermost layer), an interlayer, a filter layer, an antihalation layer, a backing layer or a like well known layer can be additionally provided.

The method of the present invention can be applied to the processing of conventional silver halide color photographic materials such as color negative films, color papers, color positive films, color reversal films for slides, color reversal films for cinema use, color reversal films for TV use, and the like.

The method of the present invention enables formation of stain and remaining of silver, which are often encountered where a ferric salt is used on a bleaching agent, to be prevented, therefore, the dye images ultimately obtained are extremely distinct and high in density. Accordingly, the method of the present invention is suitable for producing color photographic pictures having increased commercial value.

Another effect of the present invention is that defects caused by conducting washing or fixing after bleaching using a ferric salt (i.e., where washing is conducted, the waste water used is so contaminated with ferric ions that large-scale waste water processing becomes necessary and, where fixing is conducted, a fixing solution is contaminated with ferric ions which shorten the life of the fixing solution) can be removed. That is, the method of the present invention enables a marked reduction in the contamination of the fixing solution with ferric ions and a marked control of the effusion of ferric ions into waste water.

The present invention will now be illustrated in greater detail by reference to the following non-limiting examples of preferred embodiments of the present invention. Unless otherwise indicated all parts, percents, ratios and the like are by weight.

EXAMPLE 1

1-Hydroxydodecyl-2-naphthamide and 1-hydroxy-4-2'-ethylcarbonylphenylazo-2-naphthamide were emulsified in and mixed with a red-sensitive silver bromoiodide emulsion containing 7 mol% of silver iodide as cyan couplers. 1-(2'6,'-Dichloro-4'-methoxy)-3-{3''-[α-(2''',4'''-di-tert-amylphenoxy)-butyramido]-phenylureido}-5-pyrazolone and 1-(2',6'-dichloro-4'-methoxy)-3-{3''-[α-(2''',4'''-di-tert-amylphenoxy)-butyramido]phenylureido}-4-4'''-methoxyphenylazo-5-pyrazolone were emulsified in and mixed with a green-sensitive silver bromoiodide emulsion as magenta couplers. α-{3-[α-(2,4-Di-tert-amylphenoxy)acetamido]benzoyl}-2-methoxyacetanilide was emulsified in and mixed with a blue-sensitive silver bromoiodide emulsion as yellow couplers. These three emulsions were coated, in sequence, on a cellulose triacetate film to prepare color negative photographic materials. There were exposed using a sensitometer, then subjected to two development processings, respectively, at 24° C using the following procedure solutions.

| Processing A | | Processing B | |
|---|---|---|---|
| Processing Step | Time | Processing Step | Time |
| Color Develop-ment | 12 min | Color Develop-ment | 12 min |
| Stopping | 4 min | Stopping | 4 min |
| Hardening | 4 min | Hardening | 4 min |
| Washing | 4 min | Washing | 4 min |
| Bleaching | 6 min | Bleaching | 6 min |
| Washing | 2 min | Organic Acid Bath | 2 min |
| Fixing | 4 min | Fixing | 4 min |
| Washing | 8 min | Washing | 8 min |

The compositions of the processing solutions used were as follows:

| | |
|---|---|
| Color Developer | |
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-β-hydroxyethylaniline Sulfate | 5 g |
| Metaboric Acid | 0.5 g |
| Sodium Metaborate | 77 g |
| Water to make | 1 l |
| Stopping Solution | |
| Glacial Acetic Acid | 20 ml |
| Sodium Acetate | 8 g |
| Water to make | 1 l |
| Hardening Solution | |
| Formaldehyde (40%) | 20 ml |
| Sodium Carbonate (monohydrate) | 12 g |
| Water to make | 1 l |
| Bleaching Solution | |
| Ferric Chloride (6 $H_2O$) | 100 g |
| Citric Acid | 20 g |
| Concentrated Hydrochloric Acid | 10 ml |
| Water to make | 1 l |
| Fixing Solution | |
| Disodium Ethylenediamine-tetraacetate | 2 g |
| Ammonium Thiosulfate | 120 g |
| Sodium Sulfite | 12 g |
| Water to make | 1 l |
| Organic Acid Bath | |
| Citric Acid | 20 g |
| Potassium Citrate | 10 g |
| Water to make | 1 l |

Processing A was conducted for comparison. Processing B is the processing method of the present invention.

Of the photographic characteristics obtained, the minimum densities are tabulated below.

| Processing | Photographic Characteristic | | |
|---|---|---|---|
| | Red Density | Green Density | Blue Density |
| A | 0.14 | 0.49 | 0.62 |
| B | 0.10 | 0.42 | 0.53 |

As is tabulated above, with Processing B using the organic acid bath of the present invention, the minimum density was lower than in Processing A using no such bath. Therefore, Processing B is preferable.

EXAMPLE 2

On a baryta paper were coated a silver bromide emulsion containing a yellow coupler emulsion dispersion, a silver chlorobromide emulsion containing a magenta coupler emulsion dispersion (silver chloride content: 70 mol%), a silver chlorobromide emulsion containing a cyan coupler emulsion dispersion (silver chloride content: 70 mol%), a gelatin layer containing a ultraviolet absorbing agent to prepare color paper. Each of the coupler emulsions used in the color paper was prepared by dissolving each coupler in a mixture of dibutyl phthalate and tricresyl phosphate and dispersing, as an o/w type, in a gelatin aqueous solution using sorbitan monolaurate, Turkey red oil and sodium dodecylbenzenesulfonate as dispersing and emulsifying agents. α-(2-Methylbenzoyl)aceto-(2'-chloro-5'-dodecoxycarbonyl)anilide, 1-(2',4',6'-trichlorophenyl)-3-[3''-(2''',4'''-di-t-amylphenoxyacetamido)-benzamido]-5-pyrazolone, and 1-hydroxy-4-chloro-2-n-dodecylnaphthamide were used as a yellow coupler, a magenta coupler and a cyan coupler, respectively.

The thus prepared color papers were exposed using a sensitometer, followed by subjecting each paper to the following two processings, respectively, at 30° C.

| Processing A | | Processing B | |
|---|---|---|---|
| Processing Step | Time | Processing Step | Time |
| Color Development | 6 min | Color Development | 6 min |
| Stopping | 2 min | Stopping | 2 min |
| Washing | 2 min | Washing | 2 min |
| Bleaching | 2 min | Bleaching | 2 min |
| Washing | 2 min | Organic Acid Bath | 2 min |
| Fixing | 2 min | Fixing | 2 min |
| Washing | 4 min | Washing | 4 min |
| Stabilizing | 2 min | Stabilizing | 2 min |

The compositions of the processing solutions used were as follows:

| | |
|---|---|
| Color Developer | |
| Benzyl Alcohol | 12 ml |
| Diethylene Glycol | 3.5 ml |
| Sodium Hydroxide | 2 g |
| Sodium Sulfite | 2 g |
| Potassium Bromide | 0.4 g |
| Sodium Chloride | 0.4 g |
| Borax | 4 g |
| Hydroxylamine Sulfate | 2 g |
| Ethylenediaminetetraacetic Acid | 2 g |
| 4-Amino-3-methyl-N-ethyl-N-(β-sulfonamidoethyl)aniline Sulfate | 5 g |
| Water to make | 1 l |
| Stopping Solution | |
| Sodium Thiosulfate | 10 g |
| Ammonium Thiosulfate (70%) | 30 g |
| Sodium Acetate | 5 g |
| Acetic Acid | 30 ml |
| Potassium Alum | 15 g |
| Water to make | 1 l |
| Bleaching Solution | |
| Oxalic Acid | 30 g |
| Ferric Chloride (6 $H_2O$) | 25 g |
| Potassium Bromide | 10 g |
| Water to make | 1 l |
| Fixing Solution | |
| Disodium Ethylenediamine-tetraacetate | 2 g |
| Ammonium Thiosulfate | 120 g |
| Sodium Sulfite | 12 g |
| Stabilizing Solution | |
| Sodium Citrate (2 $H_2O$) | 5 g |
| Boric Acid | 15 g |
| Sodium Metaborate | 3 g |
| Potassium Alum | 15 g |
| Water to make | 1 l |
| Organic Acid Bath | |
| Oxalic Acid | 20 g |
| Potassium Oxalate | 20 g |
| Water to make | 1 l |

Processing A was conducted for comparison. Processing B is the processing method of the present invention.

Of the photographic characteristics obtained, the minimum densities are tabulated below.

| | Photographic Characteristics Minimum Density | | |
|---|---|---|---|
| Processing | Red Density | Green Density | Blue Density |
| A | 0.12 | 0.10 | 1.07 |
| B | 0.08 | 0.07 | 1.04 |

As is tabulated above, with Processing B using the organic acid bath of the present invention, the minimum density is lower than in Processing A using no such bath. Therefore, Processing B is preferable.

EXAMPLE 3

1-Hydroxy-4-chloro-2-n-dodecylnaphthamide was emulsified in and mixed with a red-sensitive silver bromoiodide emulsion (silver iodide content: 7 mol%), as a cyan coupler. 1-(2',4',6'-Trichlorophenyl)-3-[3''-(2'',4''-di-t-amylphenoxyacetamido)-benzamido]-5-pyrazolone was emulsified in and mixed with a green-sensitive silver bromoiodide emulsion (silver iodide content: 6 mol%), as a magenta coupler. α-(2-methylbenzoyl)-aceto-(2'-chloro-5'-dodecoxycarbonyl)-anilide was emulsified in and mixed with a blue-sensitive silver bromoiodide emulsion (silver iodide content: 6 mol%), as a yellow coupler. The resulting emulsions were applied to a polyethylene terephthalate film to prepare a color reversal photographic light-sensitive material. This material was then exposed using a sensitometer, followed by the following processings.

| Processing Step | Temperature | Time |
|---|---|---|
| Prehardening | 37° C | 2 min and 30 sec |
| Neutralization | " | 30 sec |
| First Development | " | 3 min |
| First Stopping | " | 30 sec |
| Washing | " | 1 min |
| Color Development | " | 3 min and 30 sec |
| Second Stopping | " | 30 sec |
| Washing | " | 1 min |
| Bleaching | " | 2 min |
| Organic Acid Bath | " | 2 min |
| Fixing | " | 1 min |
| Washing | " | 1 min |

The composition of each processing solution was as follows.

| | |
|---|---|
| Prehardening Solution | |
| Formalin (37% aqueous solution) | 20 cc |
| Pyruvic Aldehyde (40%) | 20 cc |
| Sulfuric Acid | 2 cc |
| Sodium Sulfate | 100 g |
| Potassium Bromide | 2 g |
| Borax | 5 g |
| Water to make | 1 l |
| Neutralizing Solution | |
| Potassium Bromide | 20 g |
| Glacial Acetic Acid | 10 cc |
| Sodium Sulfate | 50 g |
| Sodium Hydroxide | 6 g |
| Glycine | 10 g |
| Water to make | 1 l |
| First Developer | |
| Sodium Hexametaphosphate | 1.0 g |
| 1-Phenyl-3-pyrazolidone | 0.3 g |
| Sodium Sulfite | 50.0 g |
| Hydroquinone | 6.0 g |
| Sodium Carbonate (monohydrate) | 35.0 g |
| Potassium Bromide | 2.0 g |
| Potassium Thiocyanate | 1.0 g |
| Potassium Iodide (0.1% aqueous solution) | 10 cc |
| Water to make | 1 l |
| First and Second Stopping Solution | |
| Acetic Acid | 25 cc |

-continued

| | |
|---|---|
| Sodium Acetate | 3 g |
| Water to make | 1 l |
| Color Developer | |
| Sodium Hexametaphosphate | 1.0 g |
| Benzyl Alcohol | 6.0 g |
| Sodium Sulfite | 5.0 g |
| Sodium Tertiary Phosphate | 40.0 g |
| Potassium Bromide | 0.2 g |
| Potassium Iodide (0.1% aqueous solution) | 10.0 cc |
| Sodium Hydroxide | 6.5 g |
| 4-Amino-3-methyl-N-ethyl-N-methanesulfonamidoethylaniline Sulfate | 10.0 g |
| Ethylenediamine | 8.0 cc |
| Water to make | 1 l |
| Fixing Solution | |
| Sodium Thiosulfate | 150 g |
| Sodium Sulfite | 10 g |
| Water to make | 1 l |

As the organic acid bath, the following 5 baths were used.

| | |
|---|---|
| Bath 1 | |
| Water | |
| Bath 2 | |
| Tartaric Acid | 10 g |
| Sodium Potassium Tartrate | 30 g |
| Water to make | 1 l |
| Bath 3 | |
| Glycolic Acid (50% solution) | 40 ml |
| Sodium Hydroxide | 5 g |
| Water to make | 1 l |
| Bath 4 | |
| Citric Acid | 30 g |
| Potassium Citrate | 20 g |
| Water to make | 1 l |
| Bath 5 | |
| Malonic Acid | 30 g |
| Sodium Hydroxide | 5 g |
| Water to make | 1 l |

Bath 1 is a water bath for comparison and Baths 2 through 5 are organic acid baths of the present invention.

Of the photographic characteristics obtained, the minimum densities are tabulated below.

| Bath | Photographic Characteristic Minimum Density | | |
|---|---|---|---|
| | Red Density | Green Density | Blue Density |
| 1 | 0.07 | 0.10 | 0.18 |
| 2 | 0.04 | 0.06 | 0.07 |
| 3 | 0.04 | 0.06 | 0.08 |
| 4 | 0.04 | 0.06 | 0.07 |
| 5 | 0.04 | 0.07 | 0.08 |

As is tabulated above, with the excellent processings according to the method of the present invention (Baths 2 - 5), stains at the high light areas are extremely small. On the other hand, much stain in high light areas occurred with those processed with the water bath which is outside the scope of the present invention.

While the invention has been described in detail and with reference to specific embodiments thereof, it will be apparent to one skilled in the art that various changes and modifications can be made therein without departing from the spirit and scope thereof.

What is claimed is:

1. In a method for developing, bleaching and then fixing an exposed color silver halide photographic material, the improvement which comprises bleaching said photographic material with a bleaching solution containing a ferric salt, then processing the photographic material with a solution containing an organic acid between said bleaching and said fixing, wherein said organic acid is an organic carboxylic acid represented by the General Formula (I) the General Formula (II) or the General Formula (III)

$$R - COOM \quad (I)$$

wherein R represents an alkyl group having 1 to 12 carbon atoms, an alkenyl group having 1 to 6 carbon atoms or a hydroxy and/or carboxy substituted alkyl group having 1 to 12 carbon atoms or alkenyl group having 1 to 6 carbon atoms; and M represents a hydrogen atom, an alkali metal atom or an ammonium group;

$$MOC(=O)-R_1-A-R_2-C(=O)OM \quad (II)$$

$$\begin{array}{l} MOC(=O)-R_3-N(R_5)-R_4-W \\ MOC(=O)-R_3-N(R_5)-R_4-C(=O)OM \end{array} \quad (III)$$

wherein A represents a hydrocarbyl group, an oxygen atom, a sulfur atom or an $=NR_6$ group wherein $R_6$ represents a hydrogen atom or a substituted or unsubstituted hydrocarbyl group; $R_1$, $R_2$, $R_3$, $R_4$ and $R_5$ each represents a substituted or unsubstituted hydrocarbyl group; W represents a —COOM or a hydroxy alkyl goup; and M represents a hydrogen atom, an alkali metal atom or an ammonium group; and wherein said ferric salt is ferric chloride, ferric nitrate, ferric sulfate, ferric bromide, ferric phosphate, ferric perchlorate, ammonium ferric sulfate, ferric citrate, ferric oxalate, or ferric acetate.

2. The method of claim 1 wherein said solution containing an organic carboxylic acid also contains an organic phosphoric acid having the General Formula (IV)

$$R_7N(CH_2PO_3M'_2)_2 \quad (IV)$$

wherein M' represents a hydrogen atom or a water-solubilizing cation and $R_7$ represents an alkyl group having 1 to 4 carbon atoms, an aryl group, an aralkyl group, an alicyclic group or a heterocyclic group selected from the group consisting of a pyrrolidylmethyl group, a pyrrolidylbutyl group, a benzothiazoylmethyl group and a tetrahydroquinolylmethyl group; or the General Formula (V)

$$R_8R_9C(PO_3M'_2)_2 \quad (V)$$

wherein $R_8$ represents a hydrogen atom, an alkyl group having 1 to 4 carbon atoms, an aralkyl group, an alicyclic group, a heterocyclic group selected from the group consisting of a pyrrolidylmethyl group, a pyrrolidylbutyl group, a benzothiazoylmethyl group and a tetrahydroquinolylmethyl group or a $-PO_3M'_2$ group; $R_9$ represents a hydrogen atom, a hydroxy group, an alkyl group having 1 to 4 carbon atoms or a $-PO_3M'_2$ group, and M' is as above defined.

3. The method of claim 1, wherein said organic carboxylic acid is acetic acid, propionic acid, butyric acid, isovaleric acid, caproic acid, capric acid, lauric acid, acrylic acid, crotonic acid, propiolic acid, malonic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, fumaric acid, citraconic acid, mesaconic acid, itaconic acid, glycollic acid, lactic acid, β-hydroxypropionic acid, tartronic acid, malic acid, oxalacetic acid, tartaric acid, citric acid, ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-hydroxyethyl)-N,N',N'-triacetic acid, sodium ethylenediamine-N-(βhydroxyethyl)-N,N',N'-triacetate, triammonium ethylenediamene-N-(β-hydroxyethyl)-N,N',N'-triacetate, propylenediaminetetraacetic acid, sodium propylenediaminetetraacetate, nitrilotriacetic acid, sodium nitrilotriacetate, cyclohexanediaminetetraacetic acid, sodium cyclohexanediaminetetraacetate, iminodiacetic acid, dihydroxyethylglycine, ethyletherdiaminetetraacetic acid, glycoletherdiaminetetraacetic acid, ethylenediaminetetrapropionic acid or phenylenediaminetetraacetic acid.

4. The method of claim 2, wherein said alkyl group for $R_7$ and $R_9$ is an unsubstituted alkyl group or a substituted alkyl group containing as substituents a hydroxy group, an alkoxy group, a halogen atom, a $—PO_3M'_2$ group, a $—CH_2PO_3M'_2$ group or a $—N(CH_2PO_3M'_2)_2$ group.

5. The method of claim 2, wherein said organic phosphonic acid is ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diaminopropanol-N,N,N',N'-tetramethylenephosphonic acid, 1,3-propanediamine-N,N,N',N'-tetramethylenephosphonic acid, 1,6-hexanediamine-N,N,N',-N'-tetramethylenephosphonic acid, o-acetamidobenzylamine-N,N-dimethylenephosphonic acid, o-toluidine,-N,N-dimethylenephosphonic acid, 2-pyridylamine-N,N-dimethylenephosphonic acid, 1-hydroxyethylidene-1, 1-diphosphonic acid, ethylidyne-1,1,1-triphosphonic acid or 1-hydroxy-2-phenylethylidene-1,1-diphosphonic acid.

6. The method of claim 1, wherein said organic acid is present in an amount of about 1 to 200 g per liter of said solution, and the pH of said solution is 3 or less.

7. The method of claim 1, wherein said silver halide photographic material comprises a support having thereon at least one silver halide photographic emulsion layer comprising a hydrophilic colloid containing a silver halide and a color coupler dispersed therein.

8. The method of claim 1, wherein said silver halide photographic material comprises a multi-layer silver halide photographic material comprising a support having thereon at least one blue-sensitive silver halide photographic emulsion layer containing a yellow color coupler, at least one green-sensitive silver halide emulsion layer containing a magenta color coupler, and at least one red-sensitive silver halide emulsion layer containing a cyan color coupler.

9. The method of claim 1, wherein said bleaching solution has a pH of 3 or lower.

10. In a method for developing, bleaching and fixing an exposed silver halide photographic material, the improvement which comprises bleaching said photographic material with a bleaching solution containing a ferric salt selected from the group consisting of ferric chloride, ferric nitrate, ferric sulfate, ferric bromide, ferric phosphate, ferric perchlorate, ammonium ferric sulfate, ferric citrate, ferric oxalate and ferric acetate and then processing the photographic material with a solution containing an organic acid selected from the group consisting of dicarboxylic acid, a hydroxycarboxylic acid and a hydroxydicarboxylic acid between the bleaching step and the fixing step.

11. The method of claim 1, wherein said bleaching solution further contains an aliphatic carboxylic acid represented by Formula (1).

12. The method of claim 1, wherein said bleaching solution further contains, as a re-halogenating agent, an alkali metal halide or an ammonium halide.

13. The method of claim 1, wherein said bleaching solution has a pH of not more than 2.

14. The method of claim 13, wherein said bleaching solution contains a mineral acid.

15. The method of claim 13, wherein said bleaching solution contains an organic acid.

16. The method of claim 1 consisting essentially of the recited steps.

17. The method of claim 1 including a washing step after said fixing.

18. The method of claim 1, wherein said solution containing an organic acid is an aqueous solution.

19. The method of claim 18, wherein said aqueous solution containing an organic acid consists essentially of said organic acid and water.

20. The method of claim 1, wherein the pH of said fixing solution is not less than 3.

* * * * *